US006655661B2

(12) United States Patent
Hovik et al.

(10) Patent No.: US 6,655,661 B2
(45) Date of Patent: Dec. 2, 2003

(54) ROTATING JACK WINCH

(75) Inventors: Jon Hovik, Faervik (NO); Knut T. Siring, Arendal (NO)

(73) Assignee: Maritime Pusnes AS, Arendal (NO)

( * ) Notice: Subject to any disclaimer, the term of this patent is extended or adjusted under 35 U.S.C. 154(b) by 0 days.

(21) Appl. No.: 10/014,969

(22) Filed: Dec. 11, 2001

(65) Prior Publication Data

US 2002/0084449 A1 Jul. 4, 2002

(30) Foreign Application Priority Data

Dec. 11, 2000 (NO) ..... 20006275

(51) Int. Cl.[7] ..... B66D 1/00
(52) U.S. Cl. ..... 254/264; 254/228
(58) Field of Search ..... 254/264, 228, 254/251, 252, 256, 257, 385, 386, 108, 109, 110, 111

(56) References Cited

U.S. PATENT DOCUMENTS 2,658,720 A * 11/1953 Coffing ..... 254/264
2,658,723 A * 11/1953 Coffing ..... 254/369
2,797,891 A * 7/1957 MacCluney ..... 254/1
3,159,382 A * 12/1964 Belanger ..... 254/105
3,284,051 A * 11/1966 Belanger ..... 254/105
3,845,935 A 11/1974 Chambers ..... 254/110
3,858,847 A 1/1975 Chambers ..... 254/108
3,860,215 A 1/1975 Chambers ..... 254/110
4,183,502 A 1/1980 Skaalen ..... 254/110
5,054,744 A * 10/1991 Essex ..... 254/228
5,909,869 A 6/1999 Sandoy et al. ..... 254/264

* cited by examiner

*Primary Examiner*—Kathy Matecki
*Assistant Examiner*—Evan Langdon
(74) *Attorney, Agent, or Firm*—Thomas Schneck

(57) ABSTRACT

A device for heaving in and paying out a chain by means of a hydraulic cylinder which by means of gripping devices engages the chain and lifts or lowers the chain a given distance while the locking device is deactivated. The structure comprises a frame provided with a lower locking device, a chain wheel guiding the chain, and an upper gripping device mounted in a bracket which is connected to the rod head of the hydraulic cylinder and the central axle of the chain wheel. The lower locking device is formed by two pawls which are pivotally mounted on separate pins. These pawls engage under a chain link and hold it securely. The upper gripping device is formed by at least one pawl which, together with a chain wheel having pockets for the chain, engages under a vertical chain link. In order for the gripping device to be able to lift or lower the chain, the hydraulic cylinder has a pivotal attachment supported in the frame, and the end of its piston rod has a head that can be supported on the same pivot pin as the pawl of the gripping device, or on a separate pivot pin.

28 Claims, 2 Drawing Sheets

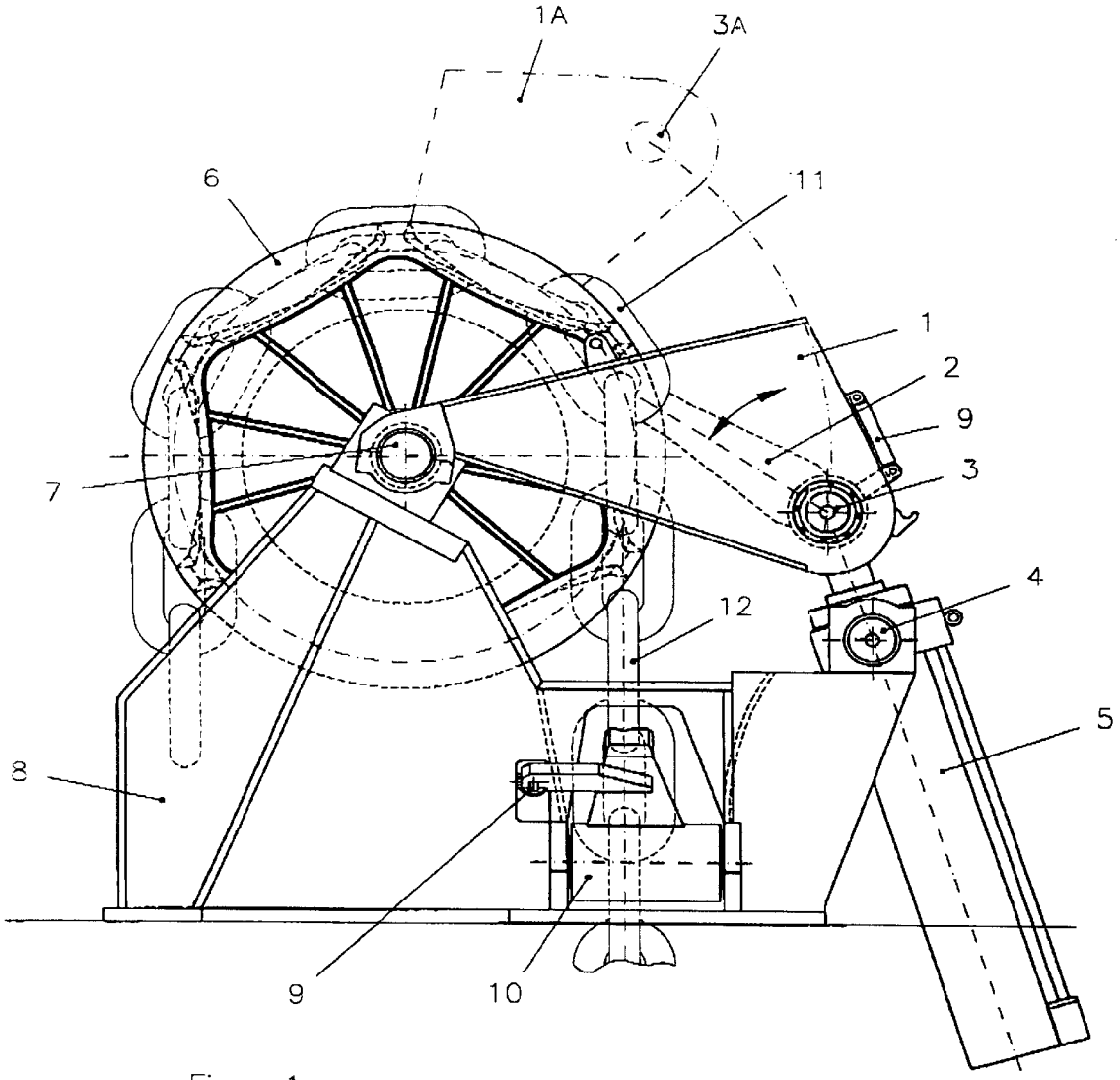
Figur 1

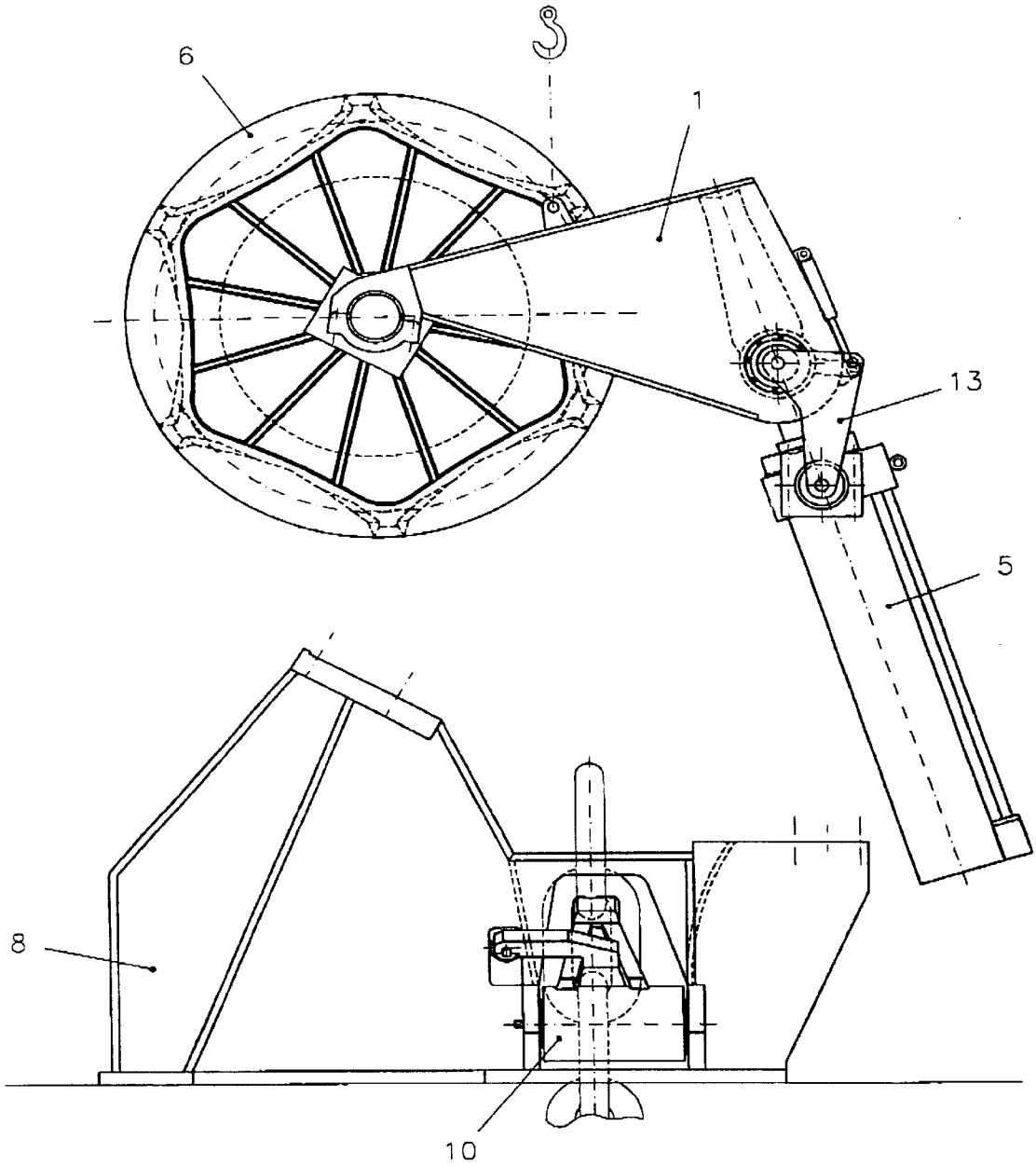
Figur 2

ROTATING JACK WINCH

This application claims priority from Norway application Ser. No. 20006275 filed Dec. 11, 2000.

The present invention concerns a device for heaving in and paying out chains using one or more hydraulic cylinders which, by means of gripping and locking devices, grip the chain and lift or lower it a little while the locking device is disengaged. When the cylinder approaches the other end of its stroke, the locking device is re-engaged, the gripping device is released from the chain and, after the hydraulic cylinder has returned to its initial position, the gripping device is ready to grip again.

Several such types of linear winches for chains exist. They usually consist of three separate units:

A locking device for chains.

A cylinder device connected to a gripping device for the chain. The cylinder device can lift or lower the chain a little more than two chain links.

A 180° guide device for the chain which is raised/lowered vertically back to a parallel vertical direction towards a box or similar for storing the chain.

The locking device and gripping device are often arranged according to the same principle: one or two pawls which engage with every other chain link using the force of gravity, springs or similar. When the chain is lifted, the as pawl(s) move aside, but the pawl(s) will fall back in place when the chain is lifted two chain links.

Such devices only work for heaving in the chain. If the chain is to be paid out, the pawls in the locking device and gripping device must be operated separately, for example by means of hydraulic auxiliary cylinders Jacking devices having two parallel cylinders can give problems regarding the synchronisation thereof, while a device having one cylinder can cause high bending moments on the piston rod. Cylinders where the working pressure acts on the rod side of the piston (the piston rod is pulling) provide reduced power as compared to cylinders where the working pressure acts on the entire piston (the piston rod is pushing).

U.S. Pat. No. 3,845,935 shows a device where the piston rod is stationary and the gripping device is attached to the cylinder. Since the chain force causes a high bending moment in the piston rod, the latter is very robust. For the cylinder there are provided two bearing supports arranged at a considerable distance from the piston rod, which increases the total length substantially. The patent does not show any 180° guide device for the chain, but this will be necessary if the device is to be used for anchor chains.

In U.S. Pat. No. 4,183,502 the bending moment in the piston rod has been avoided by placing the working cylinder centrally between two chains. This will not function properly for two anchor chains which often will have substantially different loads. The locking and gripping device is rot pawls, but two parallel bolts pushed in on either side of a chain link in order to lock the link above.

U.S. Pat. No. 5,909,869 shows a semi-circular guide device for the chain. The guide device is pivotal about a pin near the periphery, and about diagonally thereof an upper pawl is arranged which can lock the chain to the periphery of the guide device, the pawl being supported in the structure of the guide device. A frame supports the pivot pin, a lower chain stopper and a support for a pushing cylinder. The piston rod with its head is supported in the guide device. When the cylinder pivots the guide device, the chain is lifted out of the lower chain stopper until it can hold the chain two links below. When the cylinder pivots the guide device back to its starting position, the chain will slide on the guide device and the upper pawl will grip the chain two links below.

The present invention, as defined in claim 1, has some similarities to the patent mentioned above. The frame has the same functions: supporting the guide device, holding the lower chain stopper, and supporting the pushing cylinder.

However, there are substantial differences which in many instances can be advantageous: the guide device is a rotatable chain wheel having pockets for the chain, and the pawl co-operates with the pockets and constitutes the upper chain stopper. The pawl is supported in two brackets, one on either side, and the two brackets are supported for rotation about the axis of the chain wheel. The pivot pin which provides support for the pawl in the brackets, may also form the support for the head on the piston rod of the pushing cylinder, although the support for the head may instead be a third pivot pin arranged in the two brackets. The two brackets may possibly be interconnected through a suitable structure.

The U.S. Pat. No. 5,909,869 mentioned above has advantages as compared to the other patents discussed above, i.a. as regards space requirements since it has moderate dimensions. The dimensions of the winch according to the present invention may be reduced even further. The diameter of the guide device (the chain wheel) is reduced to less than half. The chain force, which is held by the lower chain stopper when the winch is not in operation, will be transmitted to the upper chain stopper in periods during the operation. The force exerted by the upper chain stopper is transmitted through the two supports in the frame. In an advantageous embodiment according to the invention, the two supports are located at about the same distance from the chain on either side. Consequently, the chain force is held by about one half by each of the two supports in the frame, and the forces may simply be transmitted further to the area of the lower chain stopper. The structure may thereby be made compact where the large loads occur.

An exemplifying embodiment of the invention is shown in the appended figures, where FIG. 1 shows an elevation of a linear winch according to the invention, and FIG. 2 shows the winch of FIG. 1 separated into its two major parts.

FIG. 1 shows the linear winch with the pushing cylinder 5 in the lower position. The bracket 1 which guides the curved stroke of the rod head and the pivot pin 3 for the pawl 2 are shown in broken lines 1A and 3A in the upper position. The pivot pin 3 for the pawl 2 and the centre of the rod head on the cylinder 5 are shown in the same position on the bracket 1, but these two may be separately positioned on the bracket. The bracket 1 is supported on the axle 7 of the chain wheel 6. The axle 7 is fixed or pivotally supported in the frame 8. The cylinder 5 is pivotally supported 4 in the frame 8, and the pawls of the lower chain stopper 10 are also pivotally supported in the frame 8. The auxiliary cylinder 9 for pivoting the pawls of the lower chain stopper 10 is supported in the frame 8. The chain is shown with finer lines and has vertical links 11 and horizontal links 12 In this context, the vertical links 11 lie in the central plane of the chain wheel 6, while the horizontal links 12 are perpendicular thereto.

FIG. 2 shows that the pushing cylinder 5, the bracket 1 and the chain wheel 6 with appurtenant details may be separated from the frame 8 with the lower chain stopper 10. The separable parts which constitute the upper chain stopper and linear winch, may be transported to other frames 8 having a lower chain stopper 10 so that the separable parts may be used for tensioning several chains. In order to facilitate the assembly, a small auxiliary bracket 13 used during transportation is shown.

The operation of a winch according to the invention is as follows:

In the initial position the chain 11, 12 is held by the lower chain stopper 10 and is guided over the chain wheel 6. When the pushing cylinder 5 is activated, the pawl 2 is pushed against the chain 11 and takes over the chain force together with the chain wheel 6. The bracket 1 guides the pivot pin 3 of the pawl 2 in such a way that its pivot follows a pivot circle about the axle 7 of the chain wheel 6. Thus, the relative position of the pawl/chain/chain wheel remains unchanged. The reference circle for the chain 11, 12 becomes about half the pivot circle for the pawl axis and, consequently, the pushing cylinder 5 has to exert a force of about half of the chain force.

When the stroke of the pushing cylinder 5 nears the end, the chain is lifted two links 11, 12, whereupon the pawl in the lower chain stopper 10 click in. The pawl 2 in the upper chain stopper slides on the chain back to the initial position wherein the pawl 2 has a small clearance to the chain 11, thus completing the cycle.

If the chain is paid out, the pawl 2 in the upper chain stopper must be pivoted out of contact with the chain 11 by means of an auxiliary cylinder 9 or the like. The pushing cylinder 5 is operated towards the upper position, and the pawl 2 is pivoted into contact with the chain 11 just before the top position. The pushing cylinder 5 is operated to the top position and thereby takes over the chain pull. The lower chain stopper 10 thereby becomes unloaded, and the pawl in this stopper 10 are pivoted out of contact with the chain 12 by auxiliary cylinder 9 or the like. The pushing cylinder 5 lowers the chain towards the lower position. The pawls in the lower chain stopper 10 are pivoted to contact with the chain 12 and take over the chain force just before the pushing cylinder 5 reaches the lower position. The cycle is thereby completed.

What is claimed is:

1. A device for heaving in and paying out a chain comprising: a frame provided with a lower locking device for the chain having one or more pawls engaging the chain, an upper gripping device, a pushing cylinder for lifting the chain, and a chain wheel having pockets for the chain, rotatably supported in the frame, characterised in that the upper gripping device comprises at least one pawl which locks the chain to the chain wheel and is supported in a bracket which is pivotally supported with the same axis of rotation as the chain wheel, and in that the pushing cylinder is pivotally supported in the bracket and the frame.

2. A device according to claim 1, characterised in that the pawl of the upper gripping device is arranged to support a vertical chain link which is supported by a horizontal chain link, which in turn is supported by the chain wheel.

3. A device according to claim 1, characterised in that the pawl of the upper gripping device is arranged to support a vertical chain link which is also supported by the chain wheel.

4. A device according to claim 1, characterized in that the pushing cylinder is a hydraulic cylinder having extending pivot pins that are supported in the frame and having a piston rod with a head that is supported in the bracket.

5. A device according to claim 4, characterised in that the pivotal support of the head on the piston rod and the pivotal support of the pawl of the upper gripping device have a common axis of rotation.

6. A device according to claim 1, characterised in that the pawls of the upper gripping device and the lower locking device are pivotal out of and into engagement with the chain by means of auxiliary cylinders.

7. The device according to claim 1, characterised in that the bracket, the pawl of the upper gripping device, the pivotal support of the pushing cylinder and the chain wheel with its pivotal support are removable from the frame as a unit for installation on corresponding frames having a lower chain stopper.

8. A device according to claim 1, characterised in that the lower locking device for the chain comprises two pawls which are pivotally arranged symmetrically on either side of the chain path, and are arranged to form an engagement with a horizontal chain link.

9. A device according to claim 7, characterised in that the pushing cylinder is a hydraulic cylinder having extending pivot pins for support in the frame and having a piston rod with a head that is supported in the bracket.

10. A device according to claim 9, characterized in that the pivotal support of the head on the piston rod and the pivotal support of the pawl of the upper gripping device have a common axis of rotation.

11. A device according to claim 7, characterised in that the pawls of the upper gripping device and the lower locking device are pivotal out of and into engagement with the chain by means of auxiliary cylinders.

12. A device according to claim 7, characterised in that the lower chain stopper comprises two pawls which are pivotally arranged symmetrically on either side of the chain path, and are arranged to form an engagement with a horizontal chain link.

13. A device according to claim 7, characterised in that the pawl of the upper gripping device is arranged to support a vertical chain link which is also supported by the chain wheel.

14. A device according to claim 3, chracterised in that the pushing cylinder is a hydraulic cylinder having extending pivot pins for support in the frame and having a piston rod with a head that is pivotally supported in the bracket.

15. A device according to claim 14, characterised in that the pivotal support of the head on the piston rod and the pivotal support of the pawl of the upper gripping device have a common axis of rotation.

16. A device according to claim 3, characterised in that the pawls of the upper gripping device and the lower locking device are pivotal out of and into engagement with the chain by means of auxiliary cylinders.

17. The device according to claim 14, characterised in that the bracket, the pawl of the upper gripping device, the pivotal support of the hydraulic cylinder and the chain wheel with its pivotal support are removable from the frame as a unit for installation on corresponding frames having a lower chain stopper.

18. A device according to claim 3, characterised in that the lower locking device for the chain comprises two pawls which are pivotally arranged symmetrically on either side of the chain path, and are arranged to form an engagement with a horizontal chain link.

19. The device according to claim 1, wherein said pushing cylinder is a hydraulic cylinder.

20. A device for heaving in and paying out a chain comprising:

a frame provided with a lower locking device for the chain having at least one pawl engaging the chain;

a chain wheel rotatably supported in the frame;

an upper gripping device having at least one pawl locking the chain to the chain wheel; and a hydraulic cylinder for lifting the chain, the at least one pawl of the upper gripping device being supported in a bracket which is pivotally supported with the same axis of rotation as the chain wheel and the hydraulic cylinder being pivotally supported in the bracket and the frame.

21. The device according to claim 20, wherein said locking device engages a tensioned part of said chain.

22. The device according to claim 20, wherein said at least one pawl of said upper gripping device locks the chain to said chain wheel at a location near an entrance point to said chain wheel.

23. The device according to claim 20, wherein said chain includes vertical and horizontal chain links.

24. The device according to claim 23, wherein said vertical chain link is disposed in a central plane of the chain wheel and said horizontal link is disposed perpendicular to said central plane.

25. The device according to claim 20, wherein said hydraulic cylinder has extending pivot pins that are supported in the frame and a piston rod with a head that is supported in the bracket.

26. The device according to claim 25, wherein the pivotal support of the head on the piston rod and the pivotal support of the pawl of the upper gripping device have a common axis of rotation.

27. The device according to claim 20, wherein the pawls of the upper gripping device and the lower locking device are pivotal out of and into engagement with the chain by means of auxiliary cylinders.

28. A device for heaving in and paying out a chain comprising:

a frame provided with a lower locking device for the chain having at least one pawl engaging the chain;

a chain wheel rotatably supported in the frame;

an upper gripping device having at least one pawl locking the chain to the chain wheel; and a lifting device for the chain, the at least one pawl of the upper gripping device being supported in a bracket which is pivotally supported with the same axis of rotation as the chain wheel, the lifting device being pivotally supported in the bracket and the frame, and the upper gripping device and the lifting device being separately postionable from one another in the bracket.

* * * * *